United States Patent [19]

Vacanti

[11] Patent Number: 4,512,037

[45] Date of Patent: Apr. 23, 1985

[54] PROTECTIVE PAD ASSEMBLY

[75] Inventor: Eugene J. Vacanti, Edina, Minn.

[73] Assignee: Sports Marketing, Inc., Minneapolis, Minn.

[21] Appl. No.: 409,014

[22] Filed: Aug. 17, 1982

[51] Int. Cl.[3] ..... A41D 13/00

[52] U.S. Cl. ..... 2/2; 2/22

[58] Field of Search ..... 2/16, 22, 23, 24, DIG. 6, 2/2; 5/420, 434, 450

[56] References Cited

U.S. PATENT DOCUMENTS

| | | | |
|---|---|---|---|
| 1,744,384 | 1/1930 | Hood | 2/22 |
| 2,368,433 | 1/1945 | Terry | 2/24 |
| 2,609,537 | 9/1952 | Pfaff | 2/22 |
| 2,818,571 | 1/1958 | Grant | 2/22 |
| 3,044,075 | 7/1962 | Rawlings | 2/22 |
| 3,088,115 | 5/1963 | Groot | 2/2 |
| 3,248,738 | 5/1966 | Morgan | 2/2 |
| 3,257,666 | 6/1966 | Hoffman | 2/2 |
| 3,307,318 | 3/1967 | Bauman | 52/743 |
| 3,327,449 | 6/1967 | Hullhorst et al. | 53/438 |
| 3,344,433 | 10/1967 | Stapenhill | 2/420 |
| 3,477,067 | 11/1969 | Aileo | 2/DIG. 6 |
| 3,507,727 | 4/1970 | Marshack | 5/434 |
| 3,541,752 | 11/1974 | Ness | 53/436 |
| 3,784,984 | 1/1974 | Aileo | 2/423 |
| 3,897,596 | 8/1975 | Aileo et al. | 2/423 |
| 3,909,847 | 10/1975 | Holt et al. | 2/2 |
| 3,994,023 | 11/1976 | Aileo et al. | 2/417 |
| 3,999,220 | 12/1976 | Keltner | 2/413 |
| 4,023,209 | 5/1977 | Frieder, Jr. et al. | 2/6 |
| 4,120,052 | 10/1978 | Butler | 2/16 |
| 4,204,373 | 5/1980 | Davidson | 52/204 |
| 4,290,149 | 9/1981 | Aileo | 2/414 |
| 4,324,012 | 3/1982 | Cannaday | 5/432 |
| 4,325,148 | 4/1982 | Livernois | 2/2 |

*Primary Examiner*—Louis K. Rimrodt
*Assistant Examiner*—Judith L. Kravitz
*Attorney, Agent, or Firm*—Burd, Bartz & Gutenkauf

[57] ABSTRACT

A protective pad assembly usable primarily by athletes to protect body parts from injury, especially from traumatic shock as when struck by a high speed hockey puck. The pad assembly includes a relatively rigid outer shell or shield and an inner air entrained cushion releasably attached to the outer shell and closely conformable to the body part being protected. The cushion includes a flexible, shock absorbent pad covered by a flexible air impervious case. The pad is formed of a soft, springy material which expels air upon compression, such as polyurethane foam. Small openings in the case are provided for expulsion of air from the case upon deflection of the pad as under the influence of the force of impact of an external object. The amount and rate at which air is expelled from the case influences the resiliency and shock absorbency characteristics of the cushion.

14 Claims, 17 Drawing Figures

Fig.1
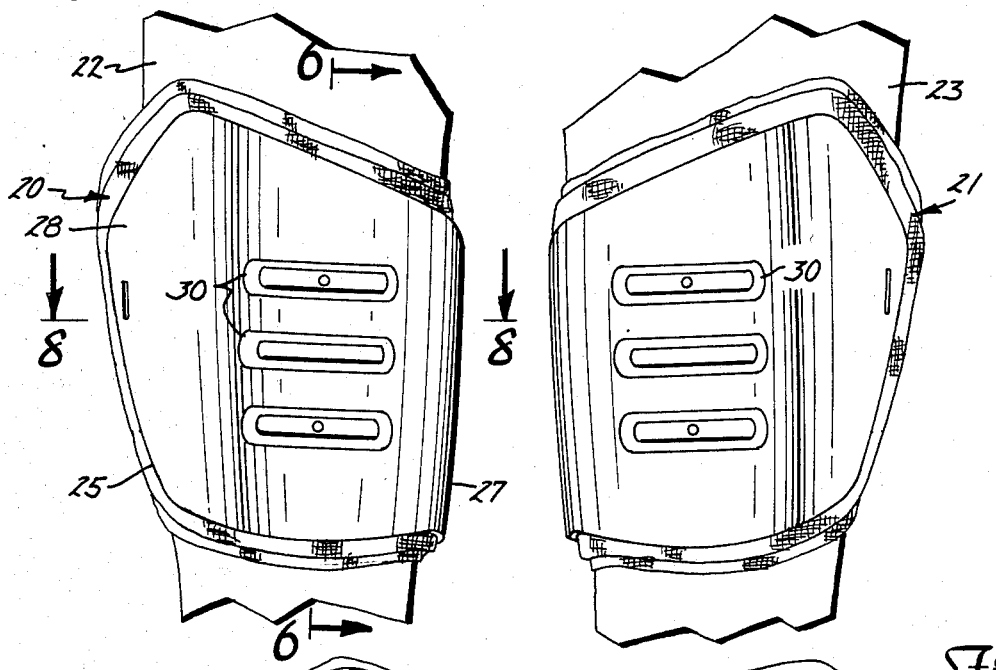
Fig.2
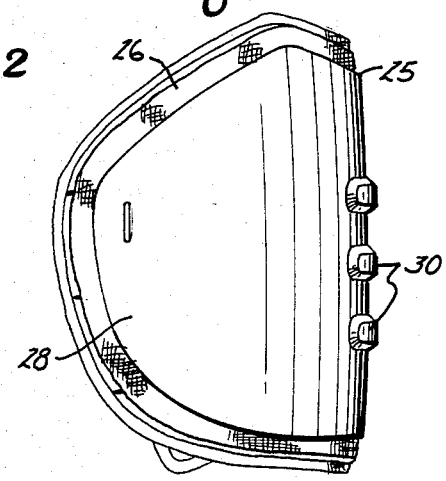
Fig.3
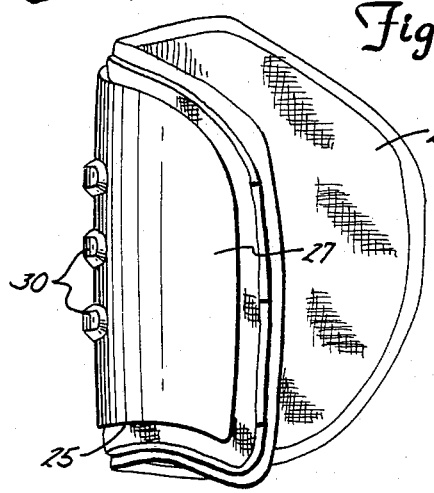
Fig.4
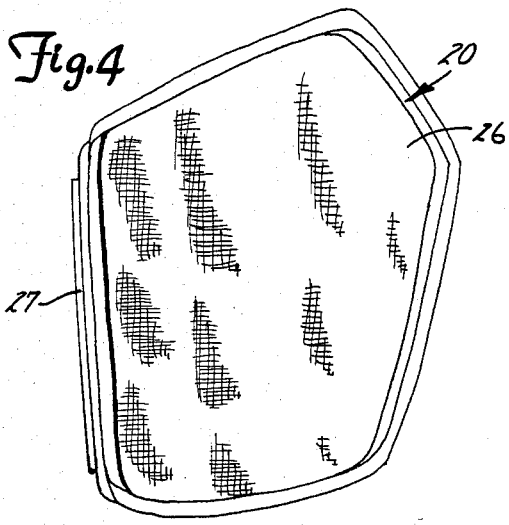
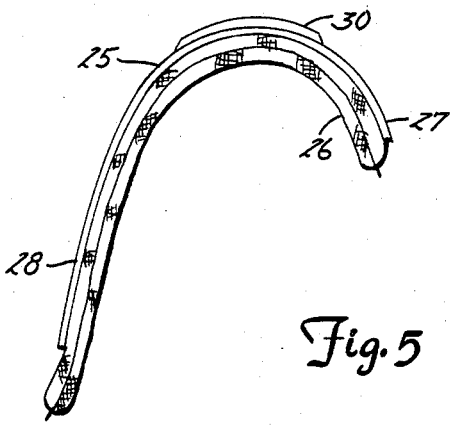
Fig.5

PROTECTIVE PAD ASSEMBLY

BACKGROUND OF THE INVENTION

The invention pertains to the field of protective garments and more particularly to protective pad assemblies for use primarily by athletes and also by others engaged in hazardous activity where there is a risk of traumatic impact to a portion of the body.

Certain sports pose such a high degree of risk of injury for the sport participant that protective equipment is desirable and usually required for the participant to be protected against injury. The sport of hockey, for example, is particularly hazardous due to the high velocity imparted to the puck as well as the momentum generated by swinging hockey sticks.

In the design and construction of protective equipment, weight and cost are considerations as well as the agility of the player while wearing the equipment and the possibility of injury to other players by the equipment.

SUMMARY OF THE INVENTION

The invention pertains to protective pad assemblies usable primarily in protective equipment for sports participants to protect body parts from injury in general and particularly from traumatic shock which can result in dangerous injury as when a player is struck by a high speed hockey puck. The pad assembly can be formed for protection of specific body parts, such as thighs, hips, shins, chest or other vulnerable body parts. The pad assembly includes a relatively rigid but somewhat pliable outer shell or shield formed in general conformance with the body part to be protected. An inner air entrained cushion is releasably attached to the outer shell and closely conforms to the body part. The cushion includes a flexible shock absorbent pad covered by a flexible air impervious case. The pad is formed of a soft springy material which expels air upon compression such as a plastic foam. The pad substantially fills the entire case. The case has a plurality of relatively small openings for the purpose of permitting expulsion of air upon deflection of the pad due to an impact on the shield. The openings allow air to flow into the case when the external force has been removed from the case. The amount and rate at which air is expelled from the case influences the resiliency and shock absorbency characteristics of the cushion. This is influenced by the size, location and number of openings in the case.

In use, an impact occasioned by an air borne object or a swung stick or the like is initially repelled by the shield. The shield distributes the force of the impact over a somewhat larger area of the pad. The pad deflects at a predetermined rate according to the amount of air expelled from the case, at the same time absorbing the shock of the impact. The force finally transferred to the body part of the participant is dissipated over a relatively large area. Following, the cushion recovers its former volume and shape as air flows through the openings back into the case. The cushion is removable from the shell for cleaning, interchanging with cushions of greater or less resiliency, repair or the like.

The cushion is constructed by initially compressing the pad and heat sealing it in the air impervious case while still compressed and prior to forming the air openings in the case. In such a state, the pad remains compressed and the cushion is more compact for storage and shipment. Prior to installation in protective equipment, the air openings are installed and the pad expands to substantially fill the internal volume of the case.

IN THE DRAWINGS

FIG. 1 is a front elevational view of a pair of pad assemblies of the invention, comprised as thigh pad assemblies for the sport of hockey fitted on the legs of a sport participant;

FIG. 2 is a right side elevational view of the right thigh pad assembly of FIG. 1;

FIG. 3 is a left side elevational view of the right thigh pad assembly of FIG. 1;

FIG. 4 is a rear elevational view of the right thigh pad of FIG. 1;

FIG. 5 is a top plan view of the right thigh pad assembly of FIG. 1;

DESCRIPTION OF A PREFERRED EMBODIMENT

Figure 6:
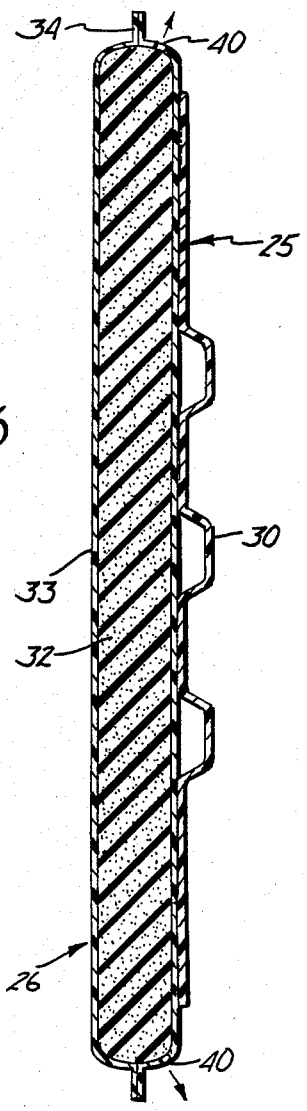
FIG. 6 is an enlarged sectional view of the thigh pad assembly of FIG. 1 taken along the line 6—6 of FIG. 1.
Figure 7:
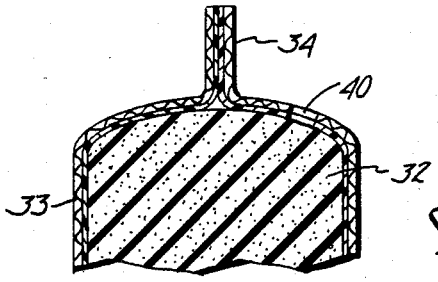
FIG. 7 is an enlarged sectional view of the upper end of the thigh pad assembly shown in FIG. 6.

Referring to the drawings, there is shown in FIG. 1 a pair of protective pad assemblies according to the invention comprised as symmetrical right and left thigh pad assemblies 20, 21 usable for hockey, fitted on thighs 22, 23 of a hockey player. Pad assemblies 20, 21 are effective to deflect blows from objects, such as pucks, hockey sticks and protective equipment, and absorb and disperse the force of impact over a large area of the protected thigh. Pad assemblies 20, 21 are for installation in suitable pockets provided in hockey trousers (not shown) to hold the pad assemblies in proper position with respect to the thighs. Releasable straps can be used to retain pad assemblies 20 and 21 on the thighs.

As shown in FIGS. 1 through 5, the left thigh pad assembly 20 includes an outer shell or shield 25 comprised of a strong, relatively rigid but somewhat pliable material such as vacuum formed plastic. Shield 25 is shaped to conform generally to the thigh of a hockey player but substantially larger in order to accommodate an air cushion 26. Shield 25 protects the medial, forward and distal portions of the thigh, having a medial side 27 located on the inside portion of the thigh, curving around the front of the thigh to the distal portion 28 located on the outside portion of the thigh. The surface of shield 25 diverges somewhat upwardly at the distal portion 28 in order to protect the greater exposed area on the outside of the leg. Shield 25 has a plurality of spaced apart, outwardly extended horizontal ribs 30 located on the front thereof. Ribs 30 serve to deflect objects that approach shield 25 from substantially a head-on direction as a speeding hockey puck. Ribs 30 also impart a measure of additional strength to the front portion of shield 25.

Cushion 26 is releasably fitted to the interior surface of shield 25. The outer perimeter of cushion 26 conforms substantially to the outer perimeter of shield 25 but is slightly larger as shown in the drawings. Cushion 26 is removable for purposes of interchangeability with cushions of greater or less thickness, or for cleaning, repair or the like. When fitted on a leg, cushion 26 closely conforms to the surface of the thigh.

Figure 9:
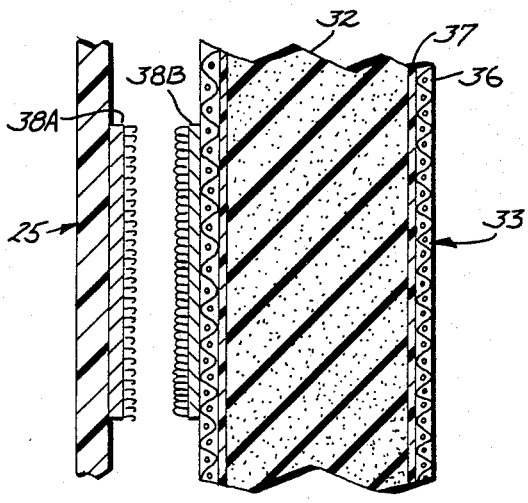
FIG. 9 is an enlarged exploded sectional view of a portion of the thigh pad assembly of FIG. 8 taken along the line 9—9 of FIG. 8.

Referring to FIGS. 6 through 9, air cushion 26 includes a soft shock absorbent pad 32 and a flexible case 33 of air impervious material. Pad 32 is formed of a springy, compressible air entrained material of the type that expels air upon compression such as foam rubber and plastic foam, and substantially fills the interior volume of case 33. An example of a suitable material is a sheet of polyurethane ether foam having a density of 1.6 pounds per cubic foot. Other types of cellular foam plastic can be used for pad 32. Pad 32 has a thickness or depth of between one-half to one inch (1.27 to 2.54 cm). The depth of the pad varies with the material and the use of the pad assemblies. Case 33 is formed of a pair of sheet members covering the sides of pad 32 and heat sealed along the edges forming a heat seal lip 34. As shown in FIG. 9, case 33 is comprised of an outer layer 36 of strong, durable and flexible material such as nylon fabric, and an inner layer 37 of air impervious material such as vinyl bonded to outer layer 36.

Figure 8:
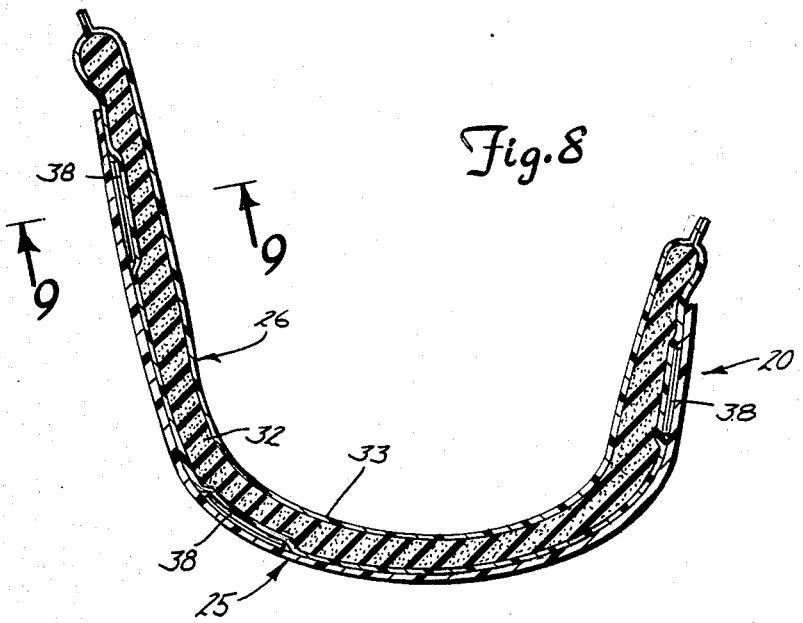
FIG. 8 is an enlarged sectional view of the thigh pad assembly of FIG. 1 taken along the line 8—8 of FIG. 1.

As shown in FIGS. 8 and 9, air cushion 26 is releasably fastened to the interior surface of shield 25 by releasable fastening strips 38 of the type having releasable interlocking surfaces that can be of the hook and loop type sold under the trademark Velcro. A plurality of first fastening strips 38A are secured to the interior surface of shield 25. A corresponding plurality of second fastening strips 38B are fastened on a side of cushion 26 located to properly position cushion 26 with respect to shield 25 when corresponding strips 38A and 38B are brought together as shown in FIG. 8.

A plurality of slit valves or small linear openings 40 are formed in case 33 to permit the escape of air from the interior thereof upon compression of pad 32 responsive to an impact, and permit entry of air upon expansion or recovery of pad 32. In addition to the resiliency characteristics of pad 32, the amount and rate at which air is permitted to be expelled from case 33 influences the shock absorbency characteristics of cushion 26. If little or no air is permitted to escape, cushion 26 would feel hard. If air were permitted to excape freely, pad 32 would substantially collapse and offer minimal resistance to the force of impact. Accordingly, the permissible air escape is regulated by openings 40. The number, spacing and size of openings 40 are parameters in regulating the permissible air excape. For example, it is desirable to have openings 40 at the lateral ends of cushion 26. Upon a central impact upon shell 25, air escapes through the lateral ends upon disperson of the impact force over a large area of pad 32 resulting in greater dispersion of the force. Openings 40 can be provided at other locations along the perimeter of cushion 26.

In use, pad assemblies 20 and 21 are located adjacent the thighs of a hockey player as shown in FIG. 1. Pockets of a suitable hockey garment (not shown) retain the pad assemblies adjacent the thighs. In terms of injury to a hockey player, a high speed, air borne puck is a worrisome source of injury although blows from a hockey stick, accidentally or otherwise, are not uncommon as well as other potential sources of injury such as collision. An air borne hockey puck, for example, impacting upon a thigh pad assembly 20 is initially deflected by shield 25. Shield 25 serves also to somewhat disperse the force of the impact. The impact force causes a deflection of pad 32. Upon deflection, pad 32 absorbs much of the impact force at a rate controlled partially by the amount of air permitted to escape through openings 40. The force of impact transmitted to the hockey player is dispersed both in time duration and surface area by the pad 32. Following deflection, pad 32 recovers its normal volume as air enters through the openings 40.

Figure 10:
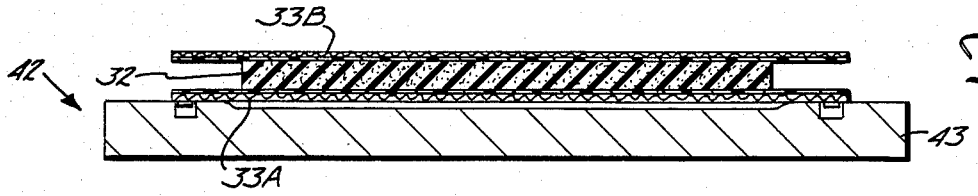
FIG. 10 is a diagramic view of a heat seal press used in the fabrication of the cushion of the thigh pad assembly showing the initial loading of the press.
Figure 11:
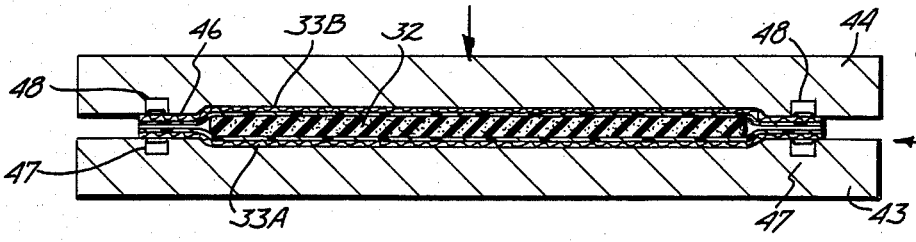
FIG. 11 is a view similar to FIG. 10 showing the compression of the cushion.
Figure 12:
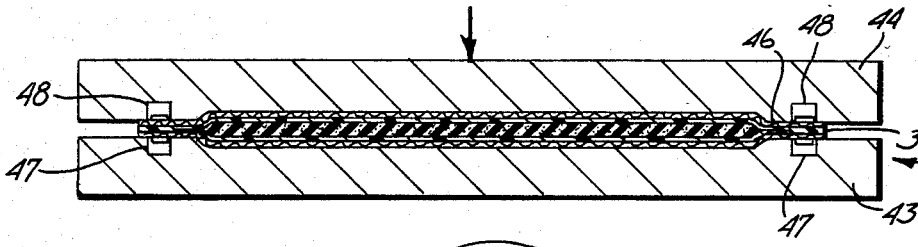
FIG. 12 is a view similar to FIG. 10 showing the heat sealing of the cushion.
Figure 13:
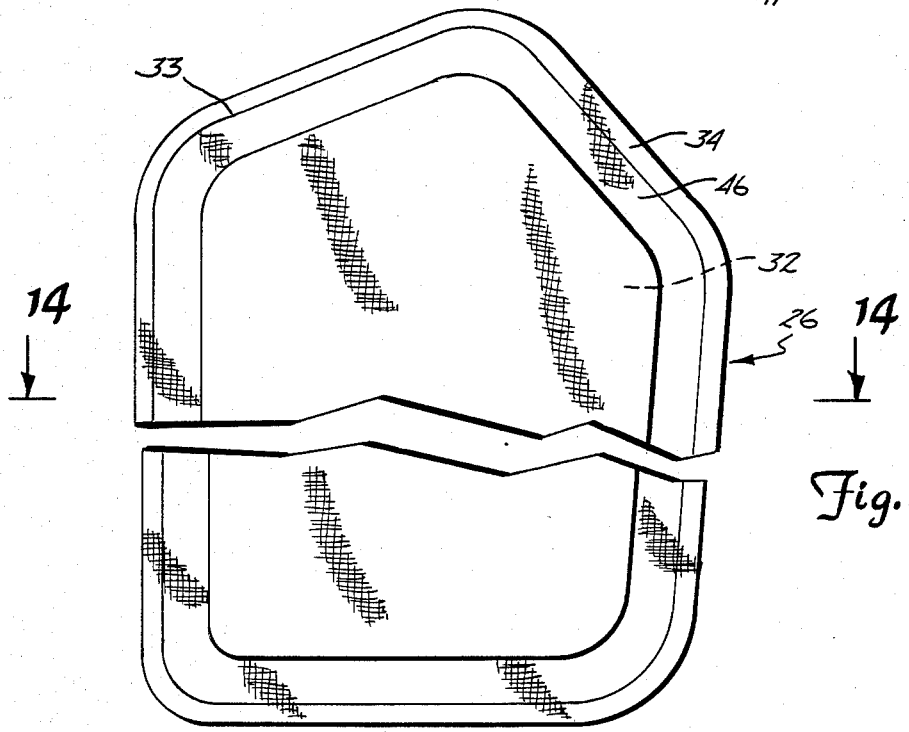
FIG. 13 is a plan view of the heat sealed cushion.
Figure 14:
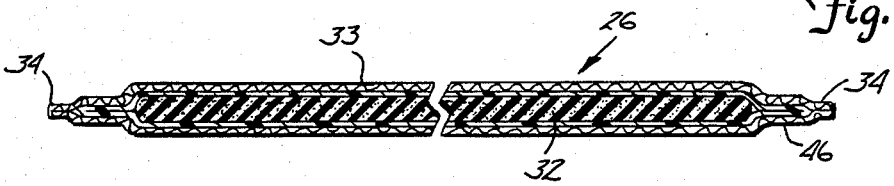
FIG. 14 is an enlarged sectional view of the heat sealed cushion of FIG. 13 taken along the line 14—14 of FIG. 13.
Figure 15:
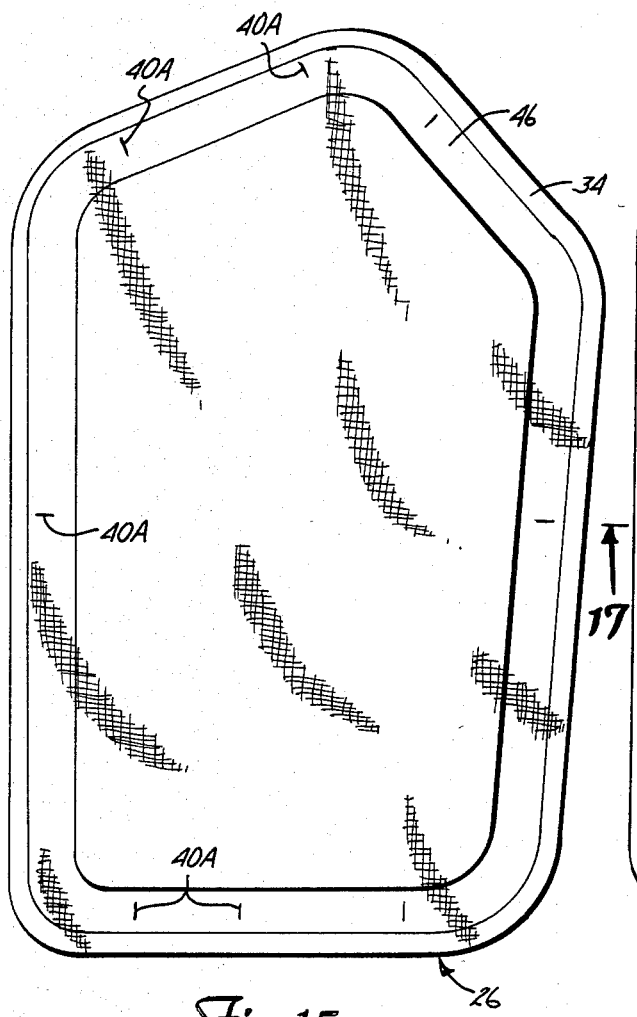
FIG. 15 is a plan view similar to that of FIG. 13 showing the vent openings scribed in the case of the cushion.
Figure 16:
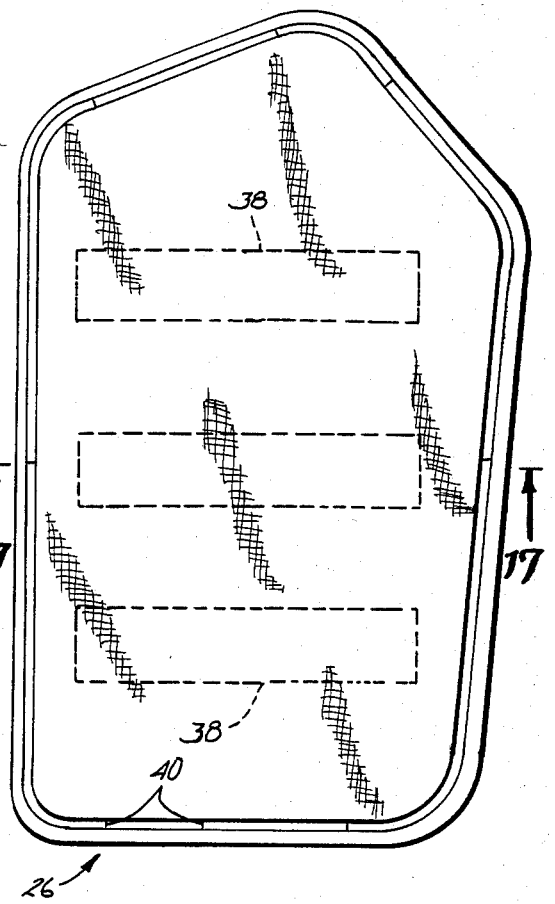
FIG. 16 is a plan view of the air expanded cushion.
Figure 17:
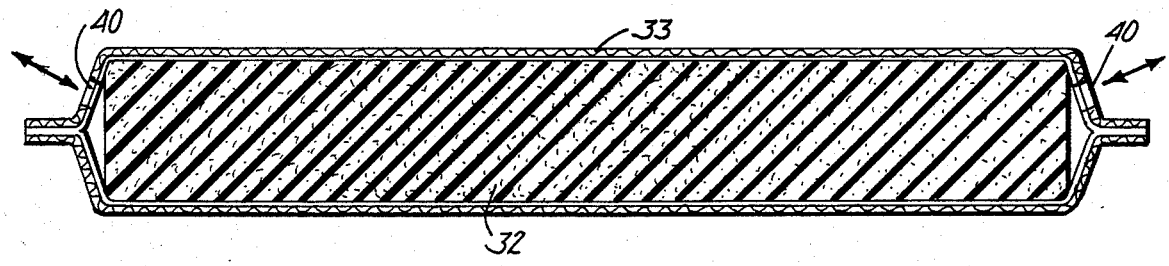
FIG. 17 is an enlarged sectional view of the air expanded cushion of FIG. 16 taken along the line 17—17 thereof.

In terms of a method of construction of a protective air cushion for use in athletic equipment, there is shown in FIGS. 10 through 12 a heat seal press 42 having a lower platten 43 and an upper platten 44. A first sheet member 33A of case material is placed on lower platten 43. Sheet member 33A can be a durable, flexible material impervious to air such as a nylon fabric material bonded to a vinyl coating. An air entrained pad 32 of compressible material in expanded form is placed on sheet member 33A and a second sheet member 33B is placed over pad 32. Sheet members 33A, 33B have greater transverse dimensions than the pad 32. As shown in FIG. 11, upper platten 44 is lowered onto lower platten 43 to compress pad 32 between the sheet members 33A, 33B. A flange 46 is formed around the outer perimeter of sheet members 33A, 33B beyond location of pad 32. As shown in FIG. 12, lower platten 43 carries heating elements 47 and upper platten 44 carries heating elements 48. When the plattens reach the position of FIG. 12, practically all air has been expelled from pad 32 and from between the two sheet members 33A, 33B. Heat elements 47, 48 seal the outer lip 34 of flange 46 to complete case 33. In such configuration, as shown in FIGS. 13 and 14, air is removed from the interior of case 33 and pad 32 is very compact. In such a compressed configuration, cushion 26 is compact for storage or transportation. As a next step, as shown in FIG. 15, markings or scores 40A are placed in the perimeter or flange 46 of collapsed air cushion 26. Scores 40A do not penetrate the material of case 33 but are merely indicative of where the openings or slits 40 will later be formed. The scores 40A are placed according to criteria as earlier described depending on the resiliency and shock absorbency to be imparted to cushion 26 by the size, number and location of the eventual openings through the case 33.

Cushion 26 can be shipped and stored in the configuration as shown in FIG. 15. At the eventual time for usage of cushion 26, openings 40 are made at the location of the scores 40A to provide openings to admit air. Pad 32 expands with air to a volume permitted by the internal volume of case 33 which selectively may or may not be a total volume to which the pad 32 would expand if unrestrained. When constrained in a less than fully expanded state, pad 32 is under slight compression to keep case 33 taut. Flange 46 expands to become the side wall of case 33. Fastening strips 38 can be applied to the case 33 for preparation for use with a shield 25.

While there has been shown and described athletic protective equipment comprised as a thigh pad assembly, it is apparent that shield 25 and cushion 26 could be configured for protection of other parts of the body such as hips, kidneys, shins and the like. It will be apparent to those skilled in the art that other deviations and changes could be had from the configurations shown without departing from the scope and spirit of the invention.

The embodiments of the invention in which an exclusive property or privilege is claimed are defined as follows:

1. A protective pad assembly for protection of a thigh of a persons body from injury, comprising:

a shield of relatively rigid material having a transverse curved shape generally in conformance with and somewhat larger than the thigh of a persons body to be protected; said shield having an outside portion locatable adjacent the outside of a thigh, an inside portion locatable adjacent the inside of the thigh, and an outer edge surrounding the shield; a cushion having an outer periphery shaped to conform to the interior surface of the shield and positioned to contact the thigh to be protected; said cushion having an outer perimeter projected outwardly from the outer edge of the shield, said cushion comprising a pad of springy compressible air entrained open cellular material of the type that expels air upon compression, and returns air into the cellular material upon expansion thereof, air impervious flexible sheet means having a chamber accommodating the pad, said pad substantially filling the chamber, said sheet means having an outer portion at the outer perimeter of the cushion, said sheet means holding the entire pad under less than complete compression thereof, and a plurality of openings in the outer portion of the sheet means for regulating air flow through the sheet means and out of the pad upon further compression of the pad from impact of an external force on the shield and through the sheet means and into the pad upon expansion of the pad, and means releasably connecting the cushion to the interior surface of the shield, said means having first members secured to the interior surface of the shield and second members secured to the sheet means, said first and second members having releasable cooperating means.

2. The protective pad assembly of claim 1 wherein:

said sheet means comprises a first layer of flexible, durable nylon type fabric material, and a second layer of air impervious vinyl type material.

3. The protective pad assembly of claim 1 wherein:

said plurality of openings in the sheet means are located in the ends and sides of the outer portion of the sheet means and are calibrated by number, size and spacing to regulate the rate of air permitted to be expelled.

4. The protective pad assembly of claim 3 wherein:

the means releasably connecting the cushion to the shield comprise a plurality of first fastening strips located on the shield and a corresponding plurality of second fastening strips located on the cushion, said first and second fastening strips having releasably interlocking surfaces positioned for engagement when the cushion is properly positioned in the shield.

5. The protective pad assembly of claim 1 wherein:

said pad is a cellular foam plastic.

6. The protective pad assembly of claim 1 including:

a plurality of outwardly extended ribs on said shield proximate the front portion thereof.

7. A protective pad assembly for protecting a body part from injury comprising:

a shield of relatively rigid material shaped generally in conformance with and somewhat larger than the body part to be protected, said shield having an outer peripheral edge, a cushion having a periphery shape to conform to the interior surface of the shield and a position to contact the body part to be protected, said cushion having an outer perimeter projected outwardly from the outer edge of the shield, said cushion including a pair of air entrained, springy compressible open cellular material of the type that expels air upon compression and returns air into the cellular material upon expansion thereof, a case having a chamber, said pad being located within the chamber and substantially filling the same, said case being of an air impervious material covering said pad, said case having an internal dimension less than the fully expanded corresponding dimension of the pad whereby the case holds the entire pad in slight compression, said case having an outer portion at the outer perimeter of the cushion, at least one opening in the outer portion of the case for regulating permissible air flow out of the chamber and pad upon compression of the pad upon compression from impact of an external force, and the flow of air into the chamber and pad upon expansion of the pad within the chamber, and means releasably connecting the cushion to the interior surface of the shield.

8. The pad assembly of claim 7 wherein:

means regulating the permissible air flow out of the case include a plurality of small openings of size, number and spacing calibrated to regulate air flow from the case upon deflection from impact of an external force.

9. The pad assembly of claim 8 wherein:

said openings are linear slits.

10. The pad assembly of claim 9 wherein:

said case is formed of first and second flexible air impervious sheet members covering the pad and heat sealed along an edge.

11. The pad assembly of claim 8 wherein:

said case comprises a first layer of flexible, durable, nylon type fabric material; and a second layer of air impervious vinyl type material.

12. The protective pad assembly of claim 7 wherein:

said pad is a cellular foam plastic.

13. The protective pad assembly of claim 7 wherein:

the means releasably connecting the cushion to the shield comprises:

a plurality of first fastening strips located on the shield and a corresponding plurality of second fastening strips located on the cushion, said first and second fastening strips having releasable interlocking surfaces position for engagement when the cushion is properly positioned in the shield.

14. The protective pad assembly of claim 7 including:

a plurality of outwardly extended ribs on said shield proximate to front portion thereof.

* * * * *

UNITED STATES PATENT AND TRADEMARK OFFICE

CERTIFICATE OF CORRECTION

PATENT NO. : 4,512,037

DATED : April 23, 1985

INVENTOR(S) : Eugene J. Vacanti

It is certified that error appears in the above-identified patent and that said Letters Patent is hereby corrected as shown below:

Column 3, line 62, "excape" should be --escape--.

Column 3, line 67, "excape" should be --escape--.

Signed and Sealed this

*Fifteenth* Day of *October 1985*

[SEAL]

*Attest:*

DONALD J. QUIGG

*Attesting Officer*

*Commissioner of Patents and Trademarks—Designate*